United States Patent [19]

Thiele

[11] Patent Number: 4,464,294

[45] Date of Patent: Aug. 7, 1984

[54] PROCESS FOR THE STABILIZATION OF RADIOACTIVE WASTES

[75] Inventor: Dietrich Thiele, Niederzier-Hambach, Fed. Rep. of Germany

[73] Assignee: Kernforschungsanlage Jülich Gesellschaft mit beschränkter Haftung, Julich, Fed. Rep. of Germany

[21] Appl. No.: 402,908

[22] Filed: Jul. 29, 1982

[30] Foreign Application Priority Data

Aug. 7, 1981 [DE] Fed. Rep. of Germany ..... 3131276

[51] Int. Cl.[3] ..... G21F 9/16

[52] U.S. Cl. ..... 252/629

[58] Field of Search ..... 252/629; 501/27, 66, 501/67

[56] References Cited

U.S. PATENT DOCUMENTS 4,314,909 2/1982 Beall et al. ..... 252/629

4,377,507 3/1983 Pope et al. ..... 252/629

FOREIGN PATENT DOCUMENTS 2484126 12/1981 France ..... 252/629

2025685 1/1980 United Kingdom ..... 252/629

OTHER PUBLICATIONS

Bauermeister et al., "Auflosungsverhalten Tonerdehaltiger Rohstoffe in der Glasschmelze", *Glastechn. Ber.* 50(2), 1977, pp. 35–44.

*Primary Examiner*—Deborah L. Kyle

*Attorney, Agent, or Firm*—Scully, Scott, Murphy & Presser

[57] ABSTRACT

A process for the consolidation or stabilization of radioactive wastes in a glass matrix, wherein a glass smelt which has been enriched with the active material is solidified through cooling. The process is distinguished in that the maximally 1200° C. hot gas smelt with the active waste within the final respository container is brought into contact prior to its cooling, at least along its surface, with a solid viscosity-increasing oxide up to at least a partial dissolution thereof. Among such oxides are aluminum oxide and zirconium oxide, wherein unsintered aluminum oxide is preferred.

11 Claims, No Drawings

PROCESS FOR THE STABILIZATION OF RADIOACTIVE WASTES

BACKGROUND OF THE INVENTION

1. Field of the Invention

The present invention relates to a process for the consolidation or stabilization of radioactive wastes in a glass matrix, wherein a glass smelt which has been enriched with the active material is solidified through cooling.

Glass serves as an extensively chemically and thermally resistant material and the processes for the vitrification of highly-radioactive wastes from reprocessing installations (for nuclear fuel) evidence a universally high degree of development. The fission product solutions are concentrated, mixed with glass formers or glass frit, dried, calcinated and melted into glass either in charges or in continuous operation in furnaces, and filled into final repository containers. These are slowly cooled in order to avoid fissures and stresses in the glass, and finally brought to the final repository location.

2. Discussion of the Prior Art

In the selection of the glass composition one is forced to undertake a certain compromise since highly-resistant glasses, which contain up to 80% $SiO_2$, require temperatures of 1300° to 1600° C. for smelting. At these high temperatures, considerable proportions of the radioactive material are volatilized. Consequently, the actually employed glasses contain a lower $SiO_2$ content besides oxides of Li, Na, K, Mg, Ca, Ba, B, Ti and similar additives which are known from the glass technology. However, such glasses have evidenced themselves as not being absolutely leach-resistant, particularly when they are subjected to conditions which are currently employed for leaching tests. Thus, fission product-containing boron silicate glass already contains after a 500 hour long exposure to carnallite leach at 200° C. and 100 at, heavily deposited crusts of corroded glass.

Investigated already as more extensively leach-resistant inclusion compounds have been aluminum oxide-containing glasses or ceramic compounds, such as are indicated in the summarizing report by G. Sachse and H. Rosenberger in "Kernenergie" 10 (1967), pages 205–210. Mentioned herein as particularly leach-resistant glass systems, among others are vitreous smelts based on $Al_2O_3$, CaO, $Na_2O$, $B_2O_3$ and $SiO_2$. Such aluminum-containing boron silicate glasses require temperatures at or above 1500° C. for smelting, which are undesirably high for the fission product stabilization.

Furthermore, a considerable tendency towards spontaneous crystallization consists in glasses engendering physical and chemical changes which can extensively exert themselves on the mechanical destructability, leaching resistance and heat conductivity, as well as on other properties. Thus, it has already attempted to convert such glasses into glass ceramics having further improved properties through controlled crystallizations (A.De, et al in "Atomwirtschaft" 1975, pages 359–360). For the formation of such a glass ceramic, the glass compound which has already been smelted at a high temperature must be subjected to an up to 24-hour long controlled thermal treatment at high temperatures in the proximity of the smelting point. In a larger scale, such techniques have been ascertained as being realizable only with difficulty and as not quite satisfactory.

Due to this reason, there has been developed in Sweden the socalled Asea process for fission product stabilization in which calcinated fission products are mixed with aluminum oxide and are solidified into a monolith under a compressive pressure of a few 100 atm at about 800° to 900° C., which should be stable in carnallite leach. Such a monolith formation under extraordinarily high pressures hardly appears to be a standard process for the stabilization of radioactive wastes.

This means, that in order to achieve the best possible leaching resistance from glass-like or ceramic-like fission product-containing compounds, there are employed either extremely complex or not fully investigated techniques or relatively high smelting temperatures, so as to cause fear of activity losses.

SUMMARY OF THE INVENTION

Accordingly, it is an object of the present invention to create a new and improved process for the stabilization or consolidation of radioactive wastes which extensively employs previously tested techniques, and which is realizable without excessive requirements, avoids intense vaporization losses and leads to a stabilized form with improved properties.

The inventive process of the above-mentioned type which has been developed for this purpose is distinguished in that the maximally 1200° C. hot glass smelt with the active waste within the final respository container is brought into contact prior to its cooling, at least along its surface, with a solid viscosity-increasing oxide up to at least a partial dissolution thereof.

Belonging to suitable oxides are aluminum oxide and zirconium oxide, wherein unsintered aluminum oxide is preferred.

It has been demonstrated that, in particular, aluminum oxide can be reabsorbed in a predetermined quantity by a fission product-containing glass smelt, which becomes thereby more viscous and during cooling will solidify with the formation of a resistant material. When unsintered aluminum oxide is suitably utilized, there will then be obtained useable solubility speeds of the oxide in the glass smelt.

When in contrast therewith, for the production of similar aluminum oxide-containing compounds one proceeds from a mixture of the components, which are then heated and brought to smelting, there are then required considerably higher temperatures which will lead to significant vaporization losses and to intensive furnace corrosion. Furthermore, the foaming with such smelts can be controlled only with difficulty and leads to bubble-permeated solid compounds, whose leaching resistance would be reduced.

In the inventive process, the smelt which is enriched with up to 30% fission products is, preferably, permitted to flow into the final repository container which, for the formation of a uniform, especially $Al_2O_3$-saturated compound is filled with nodular, fibrous or sponge-like unsintered aluminum oxide. The sufficiently highly-fluid smelt (through suitable selection of temperature or composition) rapidly fills the afforded interspaces prior to the commencement of the dissolution process with viscosity rise. In accordance with the temperature and solubility capacity of the respective glass and the desired quality improvement, the aluminum oxide is more or less partially dissolved or even completely dissolved.

Proceeding from the premise that the glass blocks will remain intact during storage, in lieu of the homogeneous protection there can also be provided only an exterior protection, in which the final repository container is provided with an aluminum oxide wall (for example, compact or in the form of a fiber mat of aluminum oxide), or with a coating applied through brushing on or flame spraying, through the dissolution of which the glass block obtains a corrosion-resistant outer skin.

The glass smelt can contain, for example, (calculated without fission products) about 50 to 70% $SiO_2$, and about 10 to 30% $B_2O_3$, as well as 6 to 12% $Na_2O$ and 1 to 6% $Li_2O$, and if required, additives such as CaO, CuO, $TiO_2$, ZnO, and/or BaO (wherein the indicated percentages signify percentages by weight). With respect to examples of special compositions, reference may be had to the reports in the GDCh Seminar "Uber Chemie und Verfahrenstechnik bei der Verfestigung flussiger hochradioaktiver Abfalle" in Julich on the 1st to the 5th of June 1981.

Particularly suitable is a composition of the glass smelt of 40 to 60% $SiO_2$, 15 to 25% $B_2O_3$, 10 to 18% CaO, 6–15% $Na_2O$, and 0 to 5% $Li_2O$.

The inventive process has the advantage that the glass smelting technology which has been employed heretofore can be retained unchanged and products formed which, besides a high leach resistance, possess an improved thermal conductivity, wherein additionally any unmixing of the glass component or an increase is extensively inhibited through the higher viscosity and the presence of aluminum oxide particles.

Pursuant to a modification of the above-described process, oxide particles, glass frit and waste can also be dosed commonly into the hot final respository container or heated together in the latter.

It is suitable to provide for a complete dissolution of the oxide in the smelt, particularly in a quantity which leads to an $Al_2O_3$ saturation of the glass, insofar as these are correlated for the required temperatures and time periods.

Particularly adapted for the formation of homogeneous compounds are relatively loose porous spheroids of at least 2mm in diameter, which are saturated by the correspondingly thinly-fluid hot smelt which must so rapidly penetrate the total mass of the poured spheroids so that there will not occur any premature rise in the viscosity. The viscousness of the smelt and the size of the interspaces, as well as the contact temperature must hereby be correlated with each other with a view towards the obtention of the uniformest possible body at the lowest possible temperature (in order to avoid vaporization losses). Suitably, smelt-propagating agents, particularly such as up to 5% of lithium oxide, can be contained in the glass material.

There can also be introduced in the glass smelt, thin $Al_2O_3$ rods and/or tubes in a suitable distribution.

Hereinbelow, the invention is now elucidated on the basis of various examples:

EXAMPLE 1

A 20 mm high poured quantity of aluminum oxide spheroids each of about 2 mm in diameter (19 ml) has poured thereon at 1100° to 1200° C., 25 ml of a glass smelt containing 20% waste (calculated as oxide) and constituted of 47% $SiO_2$, 25% $B_2O_3$, 6.3% $Na_2O$, 1.3% $Li_2O$ and 19% CaO at the same temperature, which rapidly and uniformly distributes about the poured spheroids. After maintaining this mass for 24 hours at 1100° to 1200° C., the mass is cooled down slowly.

As a result there was obtained a compact block of colored glass with spheroids partially dissolved therein.

This block was subjected for 500 hours to the influence of carnallite leach at 200° C. and 100 at. The block which was then withdrawn from the carnallite leach merely evidenced a dull surface, but no crust formation.

EXAMPLE 2

Obtained with a glass smelt containing 20% waste, having the composition 50% $SiO_2$, 22.5% $B_2O_3$; 10% $Na_2O$, 2.5% $Li_2O$ and 15% CaO, in the same manner as in Example 1, was an aluminum oxide-containing compact block which evidenced an analogous behavior in carnallite leach.

What is claimed is:

1. In a process for the stabilization of radioactive wastes in a glass matrix, wherein a glass smelt enriched with the radioactive waste is solidified through cooling; the improvement comprising contacting a thinly-fluid glass smelt at a maximal temperature of 1200° C. together with the radioactive waste within a final repository container prior to cooling thereof, with a solid viscosity- increasing oxide along at least the surface of the smelt for a period for an at least partial dissolution of the oxide in the smelt.

2. Process as claimed in claim 1, wherein said oxide comprises aluminum oxide.

3. Process as claimed in claim 1, wherein said oxide comprises unsintered aluminum oxide.

4. Process as claimed in claim 1, wherein said oxide comprises zirconium oxide.

5. Process as claimed in claim 1 or 2, wherein said oxide is applied along the wall of said final repository container.

6. Process as claimed in claim 2, characterized that the smelt is introduced into oxide constituted of nodular, fibrous or spongy aluminum oxide.

7. Process as claimed in claim 6, comprising employing said aluminum oxide in at least a saturating concentration.

8. Process as claimed in claim 6, comprising correlating the size of the interspaces between the aluminum oxide particles, the density of said particles, the viscousness of the hot thinly-fluid smelt and the contact temperature so as to obtain a uniform body at the lowest possible process temperature.

9. Process as claimed in claim 1, comprising adding a smelt-propagating agent to the glass material.

10. Process as claimed in claim 9, said agent comprising lithium oxide.

11. Process as claimed in claim 1 or 6, comprising forming a homogeneous glass block.

* * * * *